US005522114A

United States Patent [19]

Allison

[11] Patent Number: 5,522,114

[45] Date of Patent: Jun. 4, 1996

[54] CARPET CLEANING APPARATUS

[76] Inventor: Robert M. Allison, c/o Designer Carpet Cleaning, P. O. Box 21449, Saint Petersburg, Fla. 33742

[21] Appl. No.: 415,430

[22] Filed: Apr. 3, 1995

[51] Int. Cl.[6] ..... A47L 11/30

[52] U.S. Cl. ..... 15/320; 15/359; 15/385; 15/410

[58] Field of Search ..... 15/320, 385, 359, 15/410

[56] References Cited

U.S. PATENT DOCUMENTS

| | | | |
|---|---|---|---|
| 3,155,996 | 11/1964 | Berthelot et al. | 15/410 X |
| 3,264,674 | 8/1968 | Doyle et al. | 15/320 X |
| 3,375,540 | 4/1968 | Hyde | 15/320 |
| 3,663,985 | 5/1972 | Burgoon | 15/320 X |
| 3,686,707 | 8/1972 | Hughes et al. | 15/320 X |
| 3,797,065 | 3/1974 | Hughes et al. | 15/385 X |
| 4,391,017 | 7/1983 | Bruensicke | 15/410 X |

FOREIGN PATENT DOCUMENTS

| | | | |
|---|---|---|---|
| 486499 | 6/1938 | United Kingdom | 15/320 |

*Primary Examiner*—Chris K. Moore
*Attorney, Agent, or Firm*—David Kiewit

[57] ABSTRACT

An improved rotary brush carpet cleaning apparatus provides superior cleaning performance both by more efficiently dispensing shampoo onto a scrubbed portion of a carpet and by more effectively holding an extraction ring against the surface being cleaned and thereby better extracting dirt and used shampoo. The apparatus includes an arrangement of two springs (instead of the one spring used in the prior art) biasing the extraction ring downward from a chassis onto the carpet being scrubbed. The improved apparatus also minimizes operator fatigue by: a) reducing the overall weight of the cleaning machine; b) supporting the weight of a shampoo feed tank with the spinning brush, rather than on the operator's arms: and c) providing an improved mechanical advantage for resisting torques and imbalances arising from the spinning brush in a way that does not also compromise the maneuverability of the machine.

17 Claims, 4 Drawing Sheets

CARPET CLEANING APPARATUS

BACKGROUND OF THE INVENTION

This invention relates to machines for cleaning carpet by applying a cleaning solution (commonly called a shampoo), brushing or scrubbing the cleaning liquid into the carpet, and using suction to recover a portion of the shampoo and entrained dirt.

The best known prior art in this area is probably the so-called "steam cleaner", which has a carriage unit connected to a multi-element wand incorporating both a pressurized hose used to spray shampoo onto the carpet and a metallic vacuum inlet head that an operator scrubs across the carpet to suck up liquid and entrained dirt. The carriage contains a shampoo feed tank, a pump receiving cleaning liquid from the feed tank and supplying it under pressure to the spray nozzle, and a "wet-vacuum unit" comprising a blower and a recovery tank. The shampoo, in the case of a steam cleaner, is a dilute heated detergent solution comprising an emulsifier and a de-foaming agent.

A more closely related prior art carpet cleaning machine is one of the rotary brush type, disclosed by Hughes et al. in U.S. Pat. No. 3,686,707 and by Hughes in U.S. Pat. No. 3,797,065. These rotary brush machines provide better cleaning with less damage to the carpet and less operator fatigue than can steam cleaners. Rotary brush cleaners are also referred to as "foam cleaners" because they conventionally use a fairly concentrated detergent solution, comprising a foaming agent, as the shampoo.

In U.S. Pat. No. 3,686,707 Hughes et al. teach the addition, to a scrubbing machine of the type having a downwardly facing brush journaled for rotation about the shaft of a brush motor, of a tubular extractor ring mounted about the periphery of a brush-housing body by a compliant attachment means permitting the ring to oscillate about a horizontal transverse axis. The rotary scrubber taught by Hughes also comprises a cleaning liquid reservoir fixedly attached to a control handle, the reservoir feeding a cleaning solution onto the top surface of the brush. The disclosure of Hughes et al. is herein incorporated by reference.

In U.S. Pat. No. 3,797,065 Hughes teaches an improvement to the Hughes et al. machine that incorporates mounting a wet vacuum system above the brush motor. The wet vacuum system comprises a recovery tank, a blower driven by a blower motor, and a hose linking the recovery tank to the vacuum chamber extractor ring. The disclosure of Hughes is herein incorporated by reference.

There are several shortcomings of prior art rotary brush carpet cleaning machines that the inventor has sought to overcome. Cleaning solution flow in prior art rotary brush machines has been found to be inefficient because the shampoo is fed through a nozzle onto the top of a rotating brush near its periphery. Much of this shampoo is wasted by being thrown off the top of the spinning brush by centrifugal forces and only a small fraction of the shampoo follows the desired flow path through slits in the top of the brush that convey it to the brushed portion of the carpet.

Moreover, significant operator fatigue occurs in the operation of prior art rotary brush machines. One source of this arises from the placement of the shampoo feed tank on the machine's control handle. Although positioning the feed tank on the handle allows the operator to fill the tank without spilling shampoo into the blower motor, it requires that much of the weight of the filled tank be supported by the operator's arms.

SUMMARY OF THE INVENTION

An improved rotary brush carpet cleaning apparatus provides superior cleaning performance both by more efficiently dispensing shampoo onto a scrubbed portion of a carpet and by more effectively holding an extraction ring against the surface being cleaned and thereby better extracting dirt and used shampoo.

An improved rotary brush carpet cleaning apparatus minimizes operator fatigue by: a) reducing the overall weight of the cleaning machine; b) supporting the weight of a shampoo feed tank with the spinning brush, rather than on the operator's arms; and c) providing an improved mechanical advantage for resisting torques and imbalances arising from the spinning brush in a way that does not also compromise the maneuverability of the machine.

One improvement has been to provide a rotary brush carpet cleaning machine having a shampoo feed nozzle closer to the vertical axis about which the cleaning brush rotates than it is to the periphery of the brush housing; having circumferential shampoo-feeding slots in the top of the cleaning brush; and having circumferential dams on the top of the cleaning brush so as to promote shampoo flow through the central part of the cleaning brush while preventing shampoo from flowing radially off the top of the spinning brush.

It is an object of the invention to provide a rotary brush carpet cleaning machine in which the center of gravity of the feed tank is inside the circumference of the cleaning brush.

It is a further object of the invention to provide a rotary brush carpet cleaning machine having a handle with a grasp portion extendable laterally from the center of the machine by more than the width of an operator's body while the machine is cleaning carpet, and wherein that grasp portion is selectively repositioned to allow the machine to be moved through doorways and the like.

It is yet a further object of the invention to provide rotary brush carpet cleaning apparatus having a floating brush housing that does not serve as a structural support for other portions of the apparatus.

It is an additional object of the invention to provide a rotary brush cleaning machine having a long flexible hose extending from the extractor ring to the recovery tank. This hose can be disconnected, without the use any tools, from the extractor ring, and used to vacuum up dirt near a wall or other obstacle.

It is yet a further object of the invention to provide a rotary brush cleaning machine supplying a greater downward force on an extracting ring mounted outboard of the periphery of the brush housing than do prior art machines. This arrangement for holding down the extractor ring also permits greater vertical travel of the extractor ring. This arrangement uses two springs (instead of one) and supports the ring from a chassis distinct from the brush housing.

DETAILED DESCRIPTION

Figure 1:
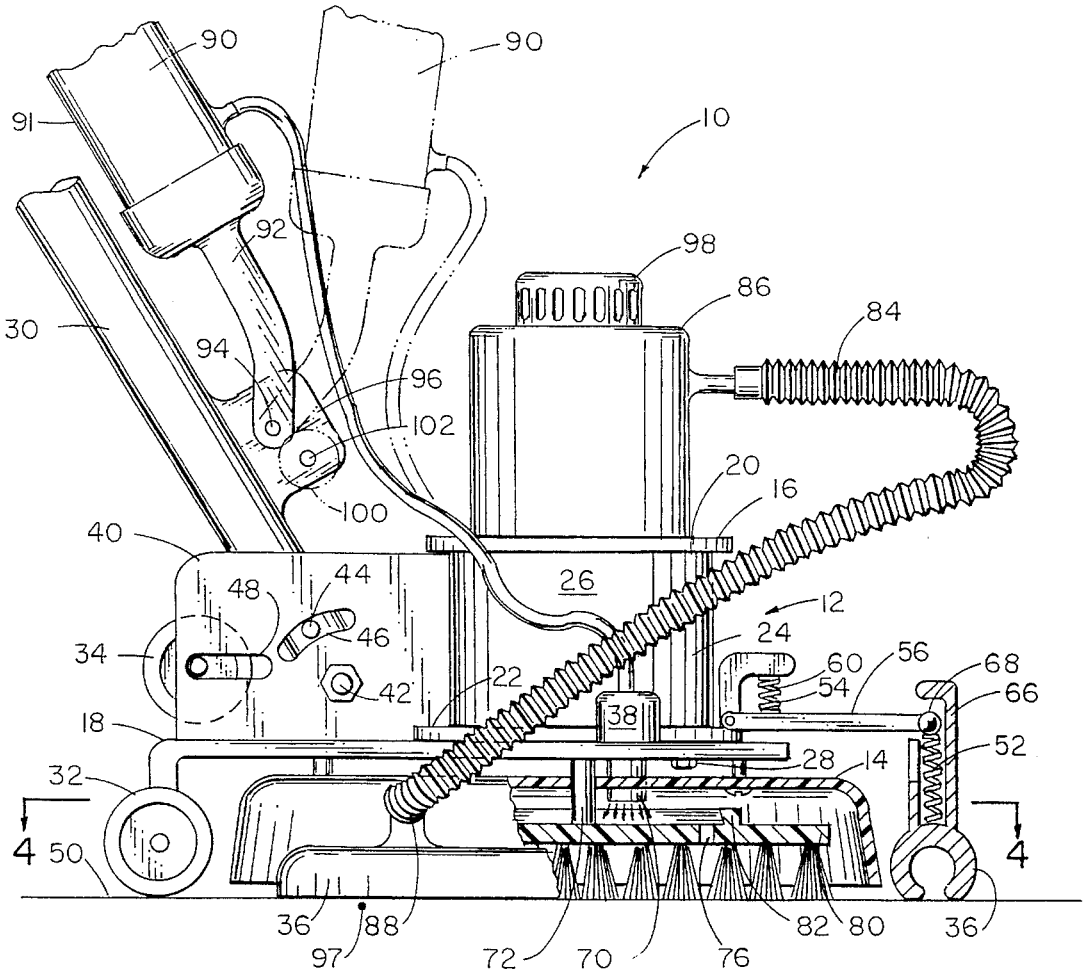
FIG. 1 of the drawing is a partly cut-away side elevational view of a carpet cleaning machine of the invention.

Turning initially to FIG. 1 of the drawing, one finds a preferred carpet cleaning machine 10 of the invention, built with a chassis 12 that is distinct from the brush housing 14. The brush housing 14 extends horizontally across the top of the rotary brush 80 and, at a point outward of the circumference of the brush 80, extends generally vertically downward toward the carpet or other scrubbed surface 50. The brush housing 14 is a thin shell-like member that does not form a support means for other elements of the structure. The reduction of weight achieved by making the brush housing 14 a non-supporting element provides a machine 10 that is lighter, stronger, and more economical to manufacture than the prior art machines taught in U.S. Pat. No. 3,686,707 and U.S. Pat. No. 3,797,065, in which a thick metal shell was used as a structural brush-housing to which other portions of the equipment were attached.

In the machine 10 shown in FIG. 1 of the drawing, the chassis 12 comprises an interconnected plurality of metal sheets 16,18. In a preferred arrangement, the bottom chassis sheet is rigidly attached to the bottom 22 of the casing 24 of the brush motor 26 by bolts 28 or other suitable fasteners. The control-handle 30; a pair of fixed wheels 32 (conventionally used to dolly the machine 10 about when it is not being used for cleaning); a retractable wheel 34; an extraction ring 36; and a shampoo inlet valve 38 (commonly called the "dump valve") are also attached to the chassis 12 by various means. In a preferred embodiment shown in FIG. 1 of the drawing, the brush housing 14 is supported by the chassis 12. It will be understood to those skilled in the art that other means of supporting the brush housing 14 (e.g., separately fastening it to the motor casing 24) could easily be employed.

A vertically disposed handle bracket 40 situated aft of the motor 26 is preferably welded to the bottom sheet 18 of the chassis 12 and provides a support for both the control handle 30 and a retractable wheel 34 used to help move the machine 10 up and down stairs. The control handle 30 may be pivotally mounted to the bracket 40 with a bolt 42 or pin, and may have a threaded hole 44 aligned with an arcuate slot 46 in the bracket 40 so that the handle 30 may be adjusted to suit the needs of operator's of varying heights. The handle 30 may be locked into position by means of screw (not shown) turned into the threaded hole 44 so as to engage a surface of the bracket 40. A second slot 48 in the bracket 40 is used to mount the retractable wheel 34, which can be pushed aft in the slot 48 when the handle 30 is lowered and pushed forwardly in the slot 48 when used to move the machine 10 up or down stairs.

Figure 2:
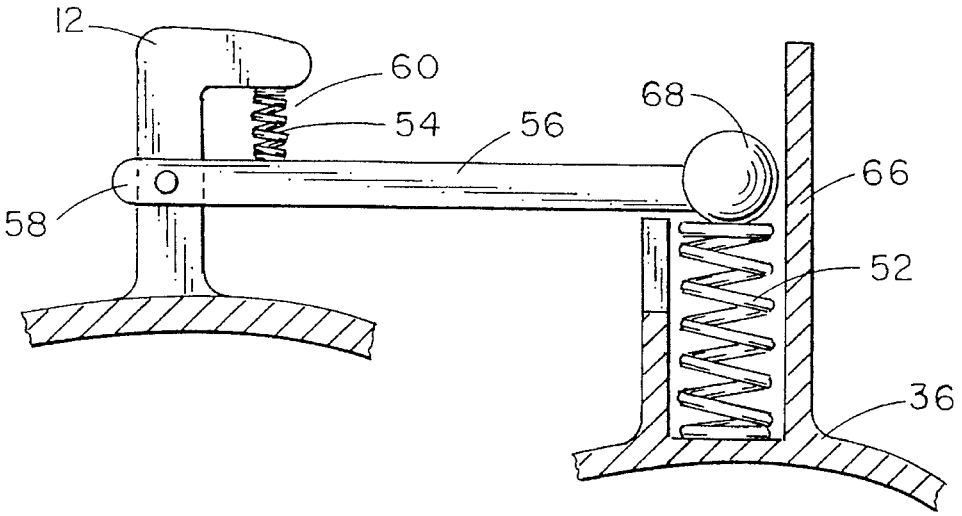
FIG. 2 of the drawing is a partly cut-away detail view of a means of attaching the suction ring to the chassis, FIG. 3 of the drawing is a partly cut-away detail view of an alternate means of attaching the suction ring to the chassis.
Figure 3:
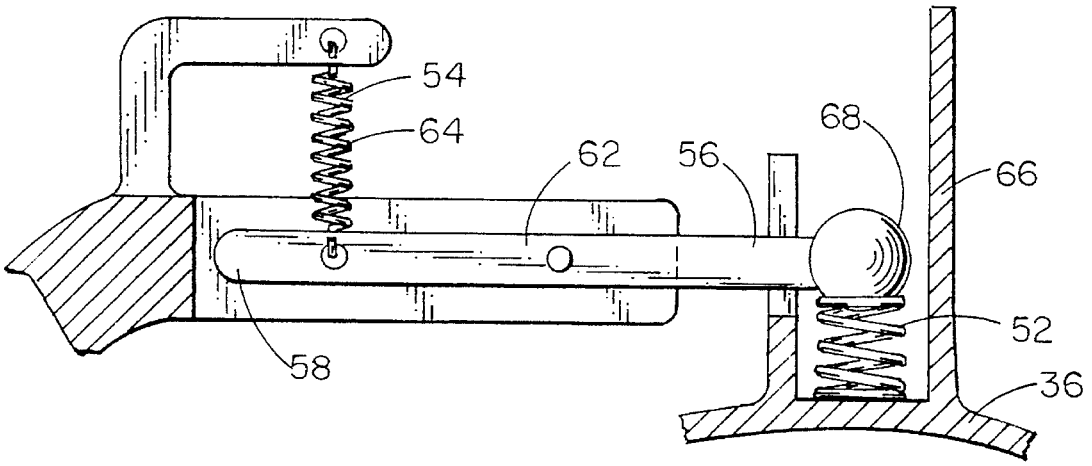

In the preferred embodiment, the vacuum chamber, commonly called the extractor or suction ring 36, extends partially around the brush housing 14 and is held against the carpet 50 by a pair of springs 52, 54 acting on an arm or lever 56. Two approaches to doing this, shown in FIG. 2 and FIG. 3 of the drawing respectively, improve on the singly-sprung prior art support by allowing greater vertical travel of the extractor ring 36 and by applying a greater downward force on the extractor ring 36, which aids in the efficiency of the cleaning process. In the preferred arrangement shown in FIG. 2 of the drawing, the inboard end 58 of the arm 56 is pivotally attached to a portion of the chassis 12 and an inboard compression spring 60 clamped between the lever 56 and a portion of the chassis acts to force the outboard end 68 lever 56 downward. In another arrangement shown in FIG. 3 of the drawing, the lever 56 is pivotally attached to the chassis 12 near the midpoint 62 of the lever 56 and an inboard tension spring 64, connected between the lever 56 and a portion of the chassis 12 biases the outboard end 68 of the arm 56 downward against the carpet being scrubbed. In both arrangements a compression spring 52, mounted in a slotted cylindrical housing 66 extending upwards from the suction ring 36 also acts to force the ring 36 downward against the carpet 50. The second spring 52 is mounted between an upper surface of the vacuum chamber 36 and an expanded, and preferably ball-like, outboard end portion 68 of the arm 56 that is restrained for vertical slidable motion within the slotted cylindrical housing 66. It is noteworthy that the preferred arrangement of FIG. 2, by providing a longer effective radius for the lever 56, ensures there is less lateral movement associated with a given vertical displacement than there would be if one uses a lever arm of shorter radius (e.g., the arrangement of FIG. 3).

The machine 10 is designed with a shampoo dispensing and dispersing arrangement superior to that known in the prior art. In prior art machines the shampoo is dispensed through a dump valve mounted to the brush housing at a location near the periphery of the housing. The shampoo, so dispensed, falls onto the top of the spinning brush and is thrown outboard of the circumference of the brush by centrifugal forces. Hence, much of the shampoo falls onto portions of the carpet that are not being scrubbed. In the present machine 10, the shampoo dispensing nozzle 70 is located as near the brush motor shaft 72 as practical. A combination of arcuate slots 76 through the top of the generally horizontal and downwardly facing brush 80, and of an arcuate dam or dams 82 outboard of the slots 76 ensure that much more of the dispensed shampoo flows onto that portion of the carpet 50 being brushed.

In the rotary brush machine of U.S. Pat. No. 3,797,065, the mixture of dirt and foamy shampoo that has been scrubbed into the carpet 50 is picked up with the extractor ring 36 and then conveyed through a pick-up hose 84 to a recovery tank 86 mounted above and coaxially with the motor 26. The machine of the invention 10 is preferably built with a hose 84 attached to the extractor ring 36 with a coupling 88 that can be demounted without the use of tools, so that the hose 84 can be used to vacuum up dirt, foam, etc. along baseboards and in other places where the extractor ring 36 can not be placed. Moreover, it has been found expedient for this additional cleaning function to make the hose 84 longer than is required for its conventional purpose of merely conveying materials from the extractor ring 36 to the recovery tank 86. In a preferred embodiment, the hose 84 is approximately four feet long.

In conventional rotary brush machines the shampoo feed tank or reservoir 90 is fixedly attached to the control-handle 30 with its rearwardly facing surface 91 adjacent the control-handle 30, where its weight (which may be 10 kg or more for a 10–12 liter tank) must largely be borne by the operator's arms. In a preferred machine of the invention 10, an arm-like support member 92 of the reservoir 90 is hinged about a pin 94 providing a horizontal pivot axis perpendicular to the axis of the control handle 30, thus allowing the tank to be moved between two limiting positions. Although the pivot point 94 is shown on an upstanding web welded onto the control handle 30, it will be understood that many alternate locations for the hinge joint 94 can be used.

In a first of the two limiting positions described supra the tank 90 is adjacent the control handle 30 –i.e., is in the same position as taught in the prior art. This position reduces the maximum height of the machine 10 as measured above the motor shaft 72, so that the machine 10 can be used in places where vertical clearance is a problem. This position may also be preferable for filling the tank 90 with fresh shampoo, as any liquids spilled in the operation will not fall onto the blower motor 98 which is conventionally mounted atop the recovery tank 86. In the second of the two limiting positions, the tank 90 is pushed forward so that it is generally above the brush motor 26 and so that its center of gravity is above a fictitious point 97 on the carpet 50 that is within the circumference of the brush 80. In this position the weight of the tank 90 and the shampoo that it contains (which can be nearly one quarter of the total weight of the machine 10) bears directly on the brush 80 and thereby increases its scrubbing effectiveness. Moreover, when in the second limiting position the weight of the tank is entirely off the operator's arms and may be balanced above the brush 80 with relatively little physical effort. In addition to these two limiting positions, the tank 90 may be put in any intermediate position and may be locked into either a limiting or a selected intermediate position by the use of locking means, such as the combination of a wide-headed clamping screw or bolt 100 (shown in phantom in FIG. 1) and a hole 102 in the mounting web 96.

Figure 4:
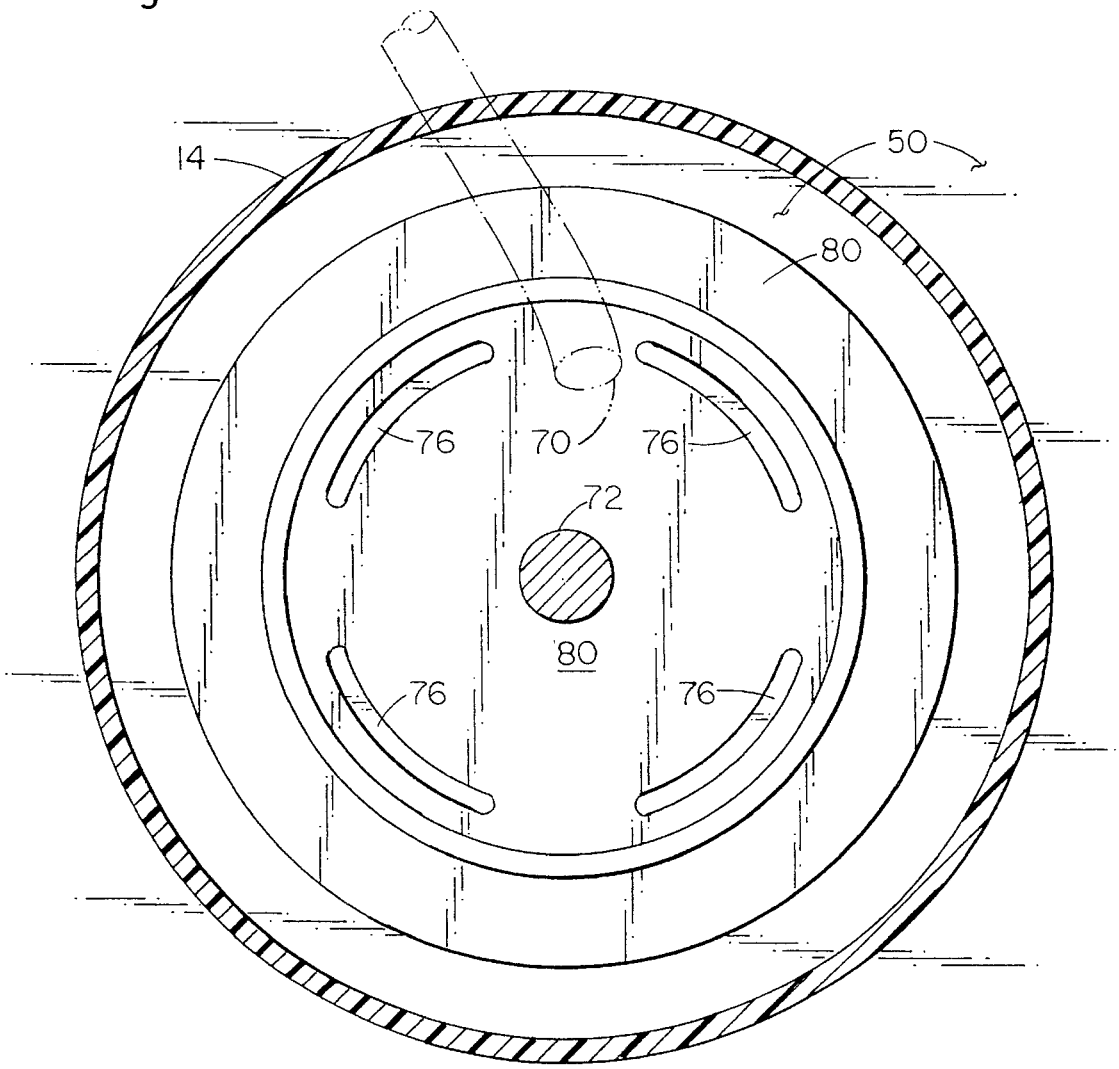
FIG. 4 of the drawing is a horizontal cross-sectional view as indicated by the arrows 4—4 in FIG. 1. This section shows a top plan view of a preferred brush.
Figure 5:
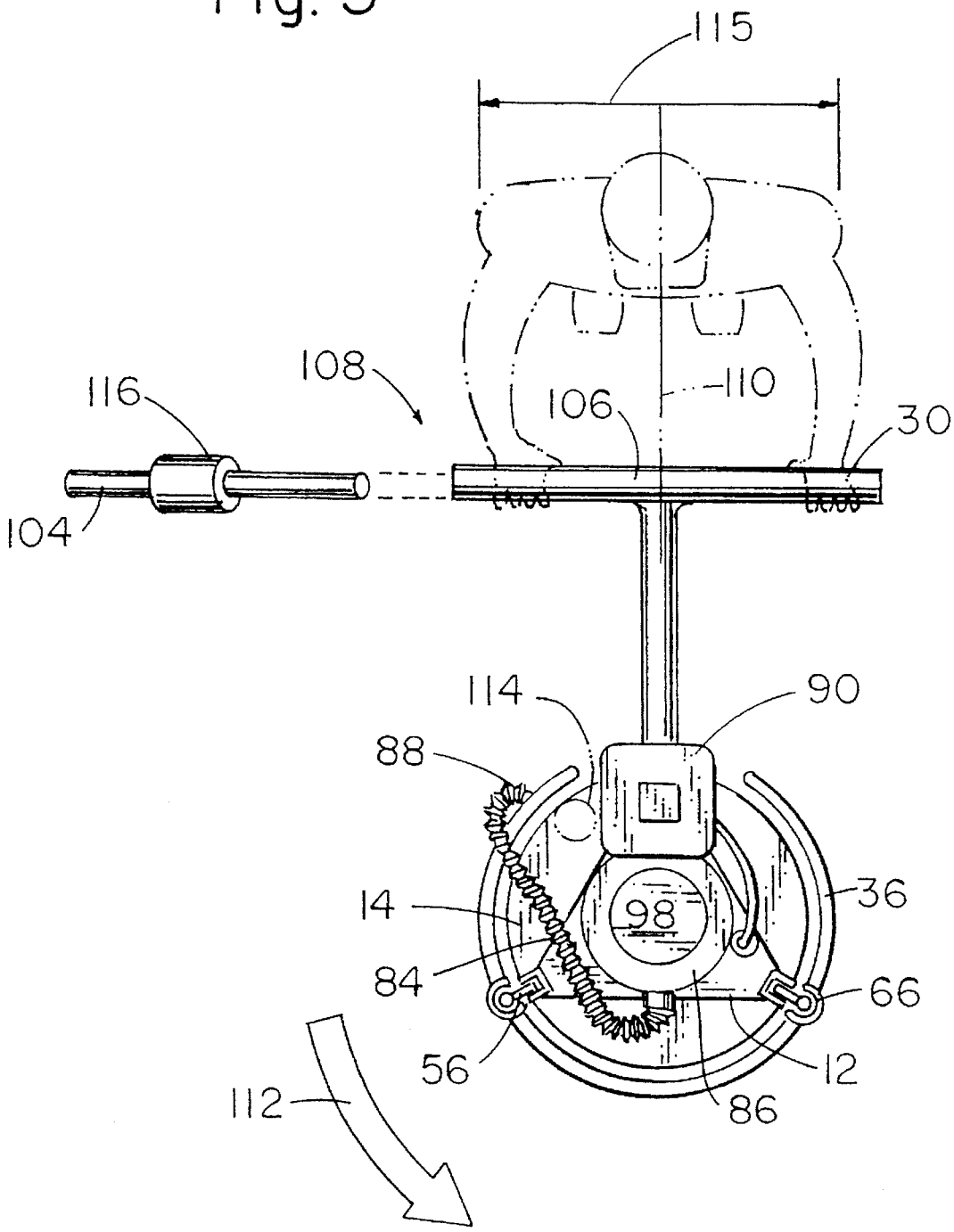
FIG. 5 of the drawing is a top plan view of the carpet cleaning machine of the invention.

Another improvement over prior art rotary brush machines is a removable extension arm 104 that is detachable from the control handle 30 without the use of tools, e.g., that may be conveniently slid into the cross-bar 106 on the control handle 30, thus creating a composite cross-arm structure 108 extending laterally farther to one side of the control handle 30 than to the other. The value of an asymmetrical extension arm 104 can be seen with respect to the illustration of FIG. 5. In a rotary brush machine 10 that is turned off, the center of gravity lies along the push-axis (shown in the drawing as a phantom line 110 encompassing the axis of the control handle 30 and the motor shaft 72). As noted supra, the exact position of the center of gravity along this line 110 can be altered in the machine of the invention 10 by moving the tank 90 forward and aft along it, but the net effect of the weight of tank 90 and of the handle 30 is to tend to lift the front of the brush 80 off the carpet 50. When the machine 10 is turned on, the torque of the brush motor 26 (indicated by the arrow 112 in FIG. 4), in combination with the weight of the machine 10 causes the brush 80 to 'dig-into' the carpet 50 and to act as though its center of gravity was displaced from the center line to a location indicated with a phantom circle 114 in FIG. 4. This requires the operator to lift upward more on the right-hand portion of the cross-bar 106 than on the left-hand side. Operator fatigue has been lessened by the addition of an extension arm 104 extending laterally from the axis of the control handle 30 by more than the operator's body width (indicated with the double-headed arrow 115 in FIG. 5 of the drawing). This provides a greater mechanical advantage for keeping the brush in a level attitude.

It is preferred that the extension arm 104 be readily demountable from the cross-bar 106 for moving the machine 10 about in restricted spaces. Dollying the machine 10 through a doorway on its fixed wheels 32, for example, is facilitated by a narrower cross-arm structure 108. It has also be found advantageous to provide a pad or other cushioned portion 116 on the extension arm so the operator can rest the pad against his or her hip and thereby more easily handle the machine 10 when scrubbing a carpet 50.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is desired to be secured by Letters Patent is:

I claim:

1. In a rotary scrubber comprising a horizontal downwardly facing rotary brush journalled for rotation about a vertical axis: a brush motor generally centered about the axis and drivingly connected to the brush: a vacuum chamber extending partially about the periphery of the brush; a wet vacuum unit comprising a recovery tank and a blower motor, the wet vacuum unit supported above the motor: an improvement comprising a chassis fixedly attached to the brush motor, the chassis having attached thereto a shampoo inlet valve, an attachment means attaching the vacuum chamber to the chassis, and a control handle; and a brush housing extending horizontally above the brush and downwardly outboard of the periphery thereof, the downwardly extending portion of the brush housing intermediate the brush and the vacuum chamber, the brush housing supporting none of the other recited elements of the scrubber.

2. Apparatus of claim 1 wherein the attachment means comprise a first spring, a second spring and a horizontal arm pivotally connected to the chassis, the arm having an inboard and an outboard end, the outboard end retained for slidable vertical motion within a housing extending upwards from the vacuum chamber, the first spring operatively attached between the arm and the chassis, the first spring biasing the outboard end of the arm downwards, the second spring operatively attached between the outboard end and the vacuum chamber, the second spring biasing the outboard end and the vacuum chamber apart from each other.

3. Apparatus of claim 2 wherein the pivotal connection between the arm and the chassis is adjacent an inboard end of the arm, and wherein the first spring is attached to the arm intermediate the inboard end and the outboard end thereof.

4. Apparatus of claim 2 wherein the pivotal connection between the arm and the chassis is adjacent a midpoint of the arm, and wherein the first spring is attached to the arm intermediate the midpoint and an inboard end of the arm.

5. Apparatus of claim 1 wherein the chassis is rigidly attached to a bottom end of the brush motor.

6. Apparatus of claim 1 further comprising a shampoo tank pivotally attached to the control handle, the tank pivoting between a first limiting position in which the tank is adjacent the handle and a second limiting position in which the center of gravity of the tank is within the circumference of the brush.

7. Apparatus of claim 1 further comprising an extension arm detachable from the control handle without the use of tools, the extension arm extending laterally from an axis of the control handle by an extent greater than the width of an operator's body.

8. Apparatus of claim 1 further comprising a flexible hose attached intermediate the recovery tank and the vacuum chamber, the hose detachable from the vacuum chamber without the use of tools .

9. In a rotary scrubber comprising a downwardly facing circular horizontal brush rotated about a vertical axis by a brush motor, a control handle extending rearwardly from the brush motor along a push axis, a cleaning solution reservoir having a rearwardly facing surface and a center of gravity, the reservoir feeding a cleaning solution onto a top surface of the brush; an improvement comprising pivotal attachment means for the reservoir allowing the reservoir to pivot between a first limiting position in which the rearwardly facing surface of the reservoir is adjacent the control handle, and a second limiting position in which the center of gravity of the reservoir is above a point on the scrubbed surface within the circumference of the brush.

10. Apparatus of claim 9 wherein the attachment means comprise a hinge pin perpendicular to the push axis, the hinge pin attaching the reservoir to the control handle.

11. In a rotary scrubber comprising a downwardly facing circular horizontal brush rotated about a vertical axis by a brush motor; a control handle extending rearwardly from the brush motor along a push axis, the control handle having a cross-arm at an end thereof distal from the brush motor: a cleaning solution reservoir feeding a cleaning solution onto a top surface of the brush; and a wet vacuum system comprising a flexible hose and a recovery tank disposed above and coaxial with the brush motor; an improvement comprising an extension arm extending laterally from one side only of the push-axis for a distance greater than the width of an operator's body.

12. Apparatus of claim 11 wherein the extension arm is attachable to the control handle without the use of tools.

13. Apparatus of claim 11 wherein the extension arm comprises a cushioned portion thereof.

14. In a rotary scrubber comprising a horizontal downwardly facing rotary brush journalled for rotation about a vertical axis, a brush motor generally centered about the axis and drivingly connected to the brush, the brush motor having a motor casing; a wet vacuum unit comprising a vacuum chamber extending partially about the periphery of the brush, a recovery tank and a blower motor; an improved means holding the vacuum chamber against a carpet being scrubbed, the means comprising a first spring, a second spring and a horizontal arm pivotally connected to the motor casing, the arm having an inboard end and an outboard end, the outboard end retained for slidable vertical motion within a housing extending upwards from the vacuum chamber, the first spring operatively attached between the arm and the motor casing, the first spring biasing the outboard end of the arm downwards, the second spring operatively attached between the outboard end and the vacuum chamber, the second spring biasing the outboard end and the vacuum chamber apart from each other.

15. Apparatus of claim 14 further comprising a chassis rigidly attached to the motor casing, the chassis intermediate the motor casing and the arm.

16. Apparatus of claim 14 wherein the pivotal connection between the arm and the motor casing is adjacent the inboard end of the arm, and wherein the first spring is attached to the arm intermediate the inboard and outboard ends thereof.

17. Apparatus of claim 14 wherein the pivotal connection between the arm and the motor casing is adjacent a midpoint of the arm, and wherein the first spring is attached to the arm intermediate the midpoint and the inboard end of the arm.

* * * * *